United States Patent [19]

Graser et al.

[11] 4,153,158

[45] May 8, 1979

[54] TWELVE-ARTICLE BASKET CARRIER

[75] Inventors: Earl J. Graser, Monroe; Jerry F. Wilson, West Monroe, both of La.

[73] Assignee: Olinkraft, Inc., West Monroe, La.

[21] Appl. No.: 921,135

[22] Filed: Jun. 30, 1978

[51] Int. Cl.[2] ..... B65D 75/00; B65D 73/00

[52] U.S. Cl. ..... 206/173; 206/187; 206/188; 229/28 BC

[58] Field of Search ..... 206/170, 173, 178, 179, 206/181, 187, 188, 189, 190, 191; 193–197; 229/28 BC, 28 R, 15

[56] References Cited

U.S. PATENT DOCUMENTS

| | | | |
|---|---|---|---|
| 2,539,966 | 1/1951 | Orovig | 206/170 X |
| 2,630,264 | 3/1953 | Holy | 229/28 BC |
| 2,721,001 | 10/1955 | Hasselhoff | 206/173 |
| 3,651,982 | 3/1972 | Slevin | 206/173 |
| 3,672,539 | 6/1972 | Forrer | 206/173 |
| 3,784,053 | 1/1974 | Stout | 229/28 BC X |
| 4,010,847 | 3/1977 | Wood et al. | 206/187 |

*Primary Examiner*—William Price
*Assistant Examiner*—Joseph Man-Fu Moy
*Attorney, Agent, or Firm*—O'Brien and Marks

[57] ABSTRACT

A foldable basket-type carrier suitable for holding twelve bottles has longitudinal partition panels connected between end wall panels on both sides of central panel and handle means thereof. Transverse partitions extend in opposite directions from the longitudinal partition panels to the side wall panels and to the central panel means completing the division of the carrier into twelve article receiving cells, two rows of three receiving cells being provided on each side of and parallel to the central panel and handle means.

11 Claims, 7 Drawing Figures

TWELVE-ARTICLE BASKET CARRIER

BACKGROUND OF THE INVENTION

1. Field of the Invention

This invention relates to foldable paperboard basket-style carriers for bottles and the like wherein two rows of article receiving cells are provided on each side of and parallel to a central partition and handle portion thereof.

2. Description of the Prior Art

The prior art, as exemplified in U.S. Pat. No. 2,721,001 and No. 3,784,053, contains a number of bottle or article carriers of the basket type having two rows of article receiving cells provided on each side of and parallel to a medial handle thereof. The U.S. Pat. No. 3,784,053 discloses spaced transverse partition strips connected between the tops of side walls and the handle structures together with longitudinal partition strips struck from the transverse partition strips; these partition strips being located toward the upper ends or shoulders of articles in the carriers do not offer full protection or separation of bottles or the like at the bottom ends or portions thereof. The U.S. Pat. No. 2,271,001 discloses separator walls or partitions folded from bottom sections; this carrier is not foldable without disassembling the carton.

Transverse partition panels struck from medial panels in six-bottle carriers of the foldable basket-type are illustrated in U.S. Pats. No. 3,672,539 and No. 4,010,847; these patents are not suitable or adaptable for carrying twelve bottles or articles.

SUMMARY OF THE INVENTION

The invention is summarized in a foldable carrier for holding twelve articles, including front and rear center panels secured back-to-back and having upper handle portions; front and rear first end panels hinged at inner edges thereof on first end edges of the respective front and rear center panels; front and rear side panels hinged at first end edges thereof on outer edges of the respective front and rear first end panels; front and rear full second end panels hinged at outer edges thereof on second end edges of the respective front and rear side panels; front and rear half second end panels hinged at inner edges thereof on second end edges of the respective front and rear center panels and secured to inside surfaces of inner portions of the respective front and rear full second end panels; front and rear bottom panel means hinged at outer edges thereof to bottom edges of the respective front and rear side panels and hinged at inner edges thereof to each other; front and rear longitudinal partition panel means hinged at second end edges thereof to outer edges of the respective front and rear half second end panels; the front and rear longitudinal partition panel means extending parallel to and midway between the front center and front side panels and between the rear center and rear side panels, respectively; the front and rear longitudinal partition panel means having respective tabs at first end edges thereof secured to the respective front and rear first end panels; and eight transverse partition panels having a first pair thereof being spaced and extending between the front side panel and the front longitudinal partition panel means, a second pair thereof being spaced and extending between the front longitudinal partition panels means and the front center panel, a third pair thereof being spaced and extending between the rear center panel and the rear longitudinal partition panel means, and a fourth pair thereof being spaced and extending between the rear longitudinal partition panel means and the rear side panel.

An object of the invention is to construct a new and improved article carrier of the so-called basket-type having two rows of three article receiving cells on each side of a center handle.

Another object of the invention is to provide partitions in a unitary three-by-four cell carrier wherein the partitions extend substantially the full height of the bottom portion of the articles received by the carrier.

It is yet another object of the invention to provide an alternative twelve-bottle basket carrier to existing carriers.

A further object of the invention is to eliminate or substantially reduce bottom panel sag of a three-by-four carrier when filled with bottles.

An advantage of the invention is that a single blank can be formed into a foldable basket-type carrier having partitions fully separating bottles therein.

One feature of the invention is that longitudinal partition panels are integrally connected to end wall panels at one end of a carrier and are secured to the opposite end wall panels at the other end of the carrier.

Another feature of the invention is the provision of tongues cut from overlapping transverse partitions and left within the plane of longitudinal partition panels to accomplish full bottle separation in the carrier.

Yet another feature of the invention is to provide downward extending portions on transverse partitions along the center line of cells to provide for full separation of the bottle.

A still further feature of the invention is the provision of gusset panels formed in opposite diagonal corners of carrier halves on opposite sides of a handle for extending into all of the article receiving cells in the rows of cells adjoining the center handle portion to prevent bottom panel sag when filled with bottles.

Other objects, advantages and features of the invention will be apparent from the following description of the preferred embodiments taken in conjunction with the accompanying drawings.

DESCRIPTION OF THE PREFERRED EMBODIMENTS

Figure 1:
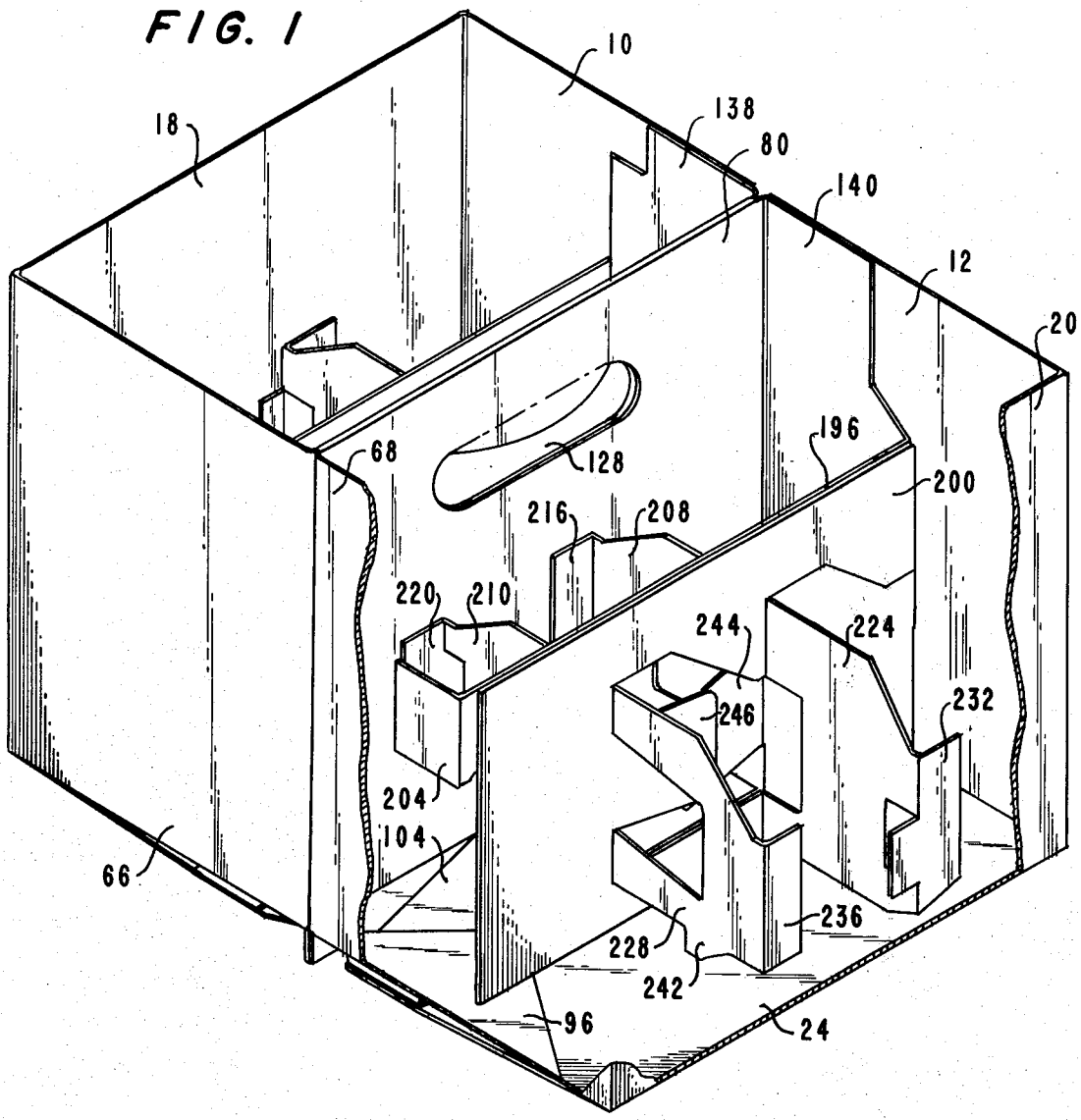
FIG. 1 is a perspective view taken toward the upper left front corner with portions broken away of an article carrier in accordance with the invention.

A foldable article carrier in accordance with the invention is illustrated in FIG. 1. This carrier is of the so-called basket-type having a center partition with an upper handle formed therein and having two rows of three article receiving cells on each side of the center partition to form a twelve-article or twelve-bottle carrier.

Figure 5:
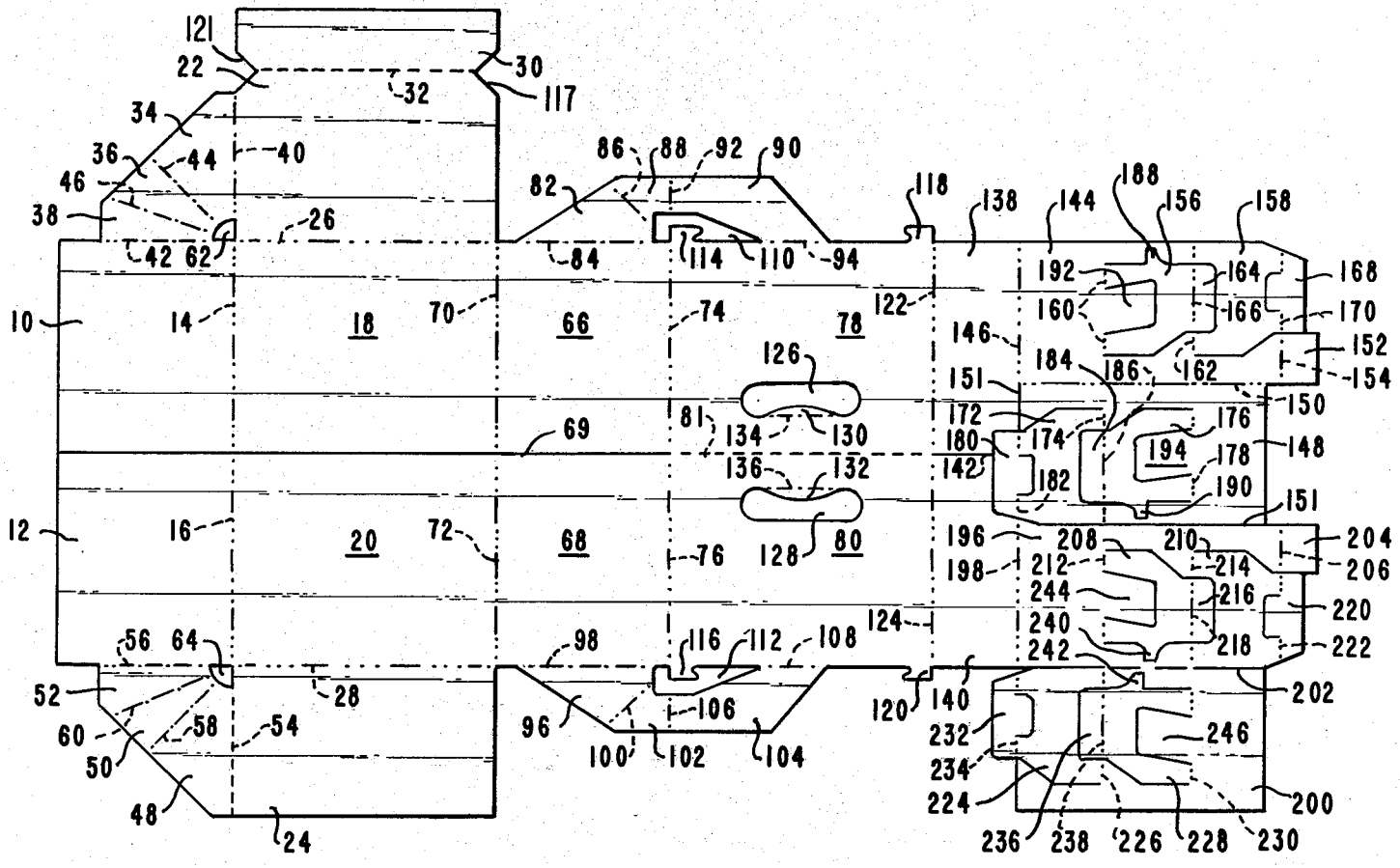
FIG. 5 is a plan view of an integral blank for forming the carrier of FIG. 1.

In FIG. 5 there is illustrated a blank including all the integrally joined or connected parts of the carrier of FIG. 1. This blank is cut from conventional paperboard material used in forming similar bottle carriers. The parts in generally the upper half of the blank as illustrated in FIG. 5 form the rear half of the carrier while the parts shown in generally the lower half of the blank of FIG. 5 form the front half of the carrier. It is noted that the front and rear halves are generally symmetrical. The adjectives "right", "left", "bottom", "outer", "inner", used hereafter refer to the carrier as assembled and shown in FIG. 1 rather than as shown in FIG. 5.

The carrier includes full right end panels 10 and 12 which are hinged at outer edges thereof at partially slit scorelines 14 and 16 to right edges of respective side panels 18 and 20. Bottom panels 22 and 24 are hinged at outer edges thereof to bottom edges of the respective side panels 18 and 20 along partially slit scorelines 26 and 28. A joint flap 30 is hinged on the inner edge of the bottom panel 22 along a scoreline 32 for being secured to the inner edge of the panel 24 to thus hinge the inner edges of the bottom panels 22 and 24 together. Gusset panels 34, 36 and 38 are formed in the right rear outer corner defined by the right edge of the rear bottom panel 22 at partially slit scoreline 40 and the bottom edge of the rear full right end panel 10 at partially slit scoreline 42. A 45° partially slit scoreline 44 is formed between the gusset panels 34 and 36 while a 22.5° angle partially slit scoreline 46 hinges the panels 36 and 38 together. A similar front right outer corner gusset arrangement is formed by gusset panels 48, 50 and 52 in the corner between the right edge of the front bottom panel 24 at partially slit scoreline 54 and the bottom edge of the front full right end panel 12 at partially slit scoreline 56. A 45° angle partially slit scoreline 58 is formed between panels 48 and 50 while a partially slit scoreline 60 is formed between panels 50 and 52 at a 22.5° angle. Cutouts 62 and 64 are formed in the extreme tip or point of the angle between edges 40 and 42 and edges 54 and 56, respectively, to facilitate folding of the gusset panels 34, 36, 38 and the gusset panels 48, 50 and 52.

The left edges of the side panels 18 and 20 are hinged to outer edges of respective left end panels 66 and 68 at partially slit scorelines 70 and 72. A cut line 69 separates the rear panels 10, 18 and 66 from the front panels 12, 20 and 68. Partially slit scorelines 74 and 76 form hinges between the inner edges of the left end panels 66 and 68 and the left edges of respective center or medial panels 78 and 80 which are hinged together at their top edges along a scoreline 81. A rear left inner corner gusset arrangement is formed by a gusset panel 82 between partially slit scoreline 84 at the bottom edge of panel 66 and a 45° partially slit scoreline 86, a gusset panel 88 between the partially slit scoreline 86 and a partially slit scoreline 92 aligned with the scoreline 74, and a panel 90 hinged to the panel 88 at the scoreline 92 and to a center portion of a bottom edge of the rear center panel 78 at partially slit scoreline 94. A similar gusset arrangement for the front left inner corner is formed by gusset panel 96 hinged at partially slit scoreline 98 on the bottom edge of the left end panel 68 and hinged at a 45° angle partially slit scoreline 100 to a gusset panel 102, the gusset panel 102 hinged at partially slit scoreline 106 aligned with scoreline 76 to a gusset panel 104, and the gusset panel 104 hinged to a center portion of a bottom edge of the front center panel 80 at partially slit scoreline 108. Cut outs 110 and 112 are formed at the corner of the intersection of lines 84, 86, 92 and 94 and at the corner of the intersection of the lines 98, 100, 106 and 108 to promote bending and folding of the gusset panels 82, 88 and 90 and the gusset panels 96, 102 and 104. The openings 110 and 112 are also cut to form hooks 114 and 116 extending downward from the left ends of the bottom edges of the center panels 78 and 80 for engaging a notch 117 formed in the left edges of bottom panel 22 and joint flap 30 at scoreline 32. Similar downward extending hooks 118 and 120 are formed at the right ends of the bottom edges of the respective center panels 78 and 80 adjacent right edge score lines 122 and 124 thereof for engaging and supporting the bottom panels 22 and 24 at a notch 121 formed in the right edge of bottom panel 22 and joint flap 30 at the scoreline 32. Finger openings 126 and 128 are formed in the upper portions of the center panels 78 and 80 for forming a handle for the carrier. Reinforcing flaps 130 and 132 joined at partially slit scorelines 134 and 136 in the panels 78 and 80 extend downward into the respective finger openings 126 and 128 for providing reinforcement of the lifting edge of the openings 126 and 128.

Half right end panels 138 and 140 are hinged at inner edges thereof to the right edges of the respective center panels 78 and 80 along the partially slit scorelines 122 and 124. The half right end panels 138 and 140 are separated from each other at a cut 142.

An inner rear longitudinal partition panel 144 is hinged to the outer edge of the half right end panel 138 at partially slit scoreline 146 while an outer rear longitudinal partition panel 148 is hinged to the top edge of the partition panel 144 at a partially slit scoreline 150. A cut line 151 extends on two sides of the outer rear longitudinal partition panel 148 to separate the panel 148 from remaining portions of the blank except for the inner longitudinal partition panel 144. A glue tab 152 is hinged at partially slit scoreline 154 to the left edge of the rear longitudinal partition panel 144. Inner rear transverse partition panels 156 and 158 are cut from the longitudinal partition panel 144 and are hinged at outer edges thereof along respective scorelines 160 and 162 to the panel 144. A glue tab 164 is hinged at a partially slit scoreline 166 to the inner edge of the transverse panel 156 while a glue tab 168 is hinged at a partially slit score line 170 to the inner edge of the transverse panel 158. Outer rear transverse partition panels 172 and 176 are cut from the outer rear longitudinal partition panel 148 and are hinged at inner edges thereof along respective score lines 174 and 178 to the panel 148. A glue tab 180 is hinged at a scoreline 182 on the outer edge of the transverse partition panel 172 while a glue tab 184 is hinged at a partially slit scoreline 186 on the outer edge of the transverse partition panel 176. It is noted that the cuts forming the transverse panels 156 and 158 in the panel 144 extend to the left while the cuts forming the transverse panels 172 and 176 extend to the right in the panel 148. The scoreline 160 is aligned with the scoreline 174 while the scoreline 162 is aligned with the scoreline 178 to divide the longitudinal partition panels 144 and 148 into three equal longitudinal lengths. The panels 158 and 172 extend to the bottom edges of the respective panels 144 and 148 while extensions 188 and 190 are formed on the bottom edges of the transverse panels 156 and 176 for extending along the center portion thereof to a position slightly spaced above the bottom of the panels 144 and 148. Tongues 192 and 194 cut from the transverse panels 156 and 176, respectively, are left in the panels 144 and 148. These tongues 192 and 194 extend to the left and right respectively so as to overlap when the panels 144 and 148 are folded together to produce a double thickness of separating material between center cells at the rear portion of the carrier.

Similarly, inner front longitudinal partition panel 196 is hinged at its right edge at partially slit scoreline 198 to the outer edge of the front half right end panel 140. Outer front longitudinal partition panel 200 is hinged at its bottom edge along partially slit scoreline 202 to the bottom edge of the panel 196. Glue tab 204 is hinged at a partially slit scoreline 206 to the left edge of the panel 196. Inner front transverse partitions 208 and 210 are cut from the inner front longitudinal partition panel 196 and hinged thereto at their outer edges along respective score lines 212 and 214. A glue tab 216 is formed on the inner end of the transverse partition panel 208 by a slit score line 218 while a glue tab 220 is formed on the inner end of the transverse partition 210 by a partially slit scoreline 222. Cut from the longitudinal partition panel 200 are an outer front transverse partition 224 hinged at its inner edge along scoreline 226 to the panel 200 and an outer front transverse partition panel 228 hinged at its inner edge along scoreline 230 to the partition panel 200. A glue tab 232 is formed on the outer end of the transverse partition panel 224 by partially slit scoreline 234 while a glue tab 236 is formed on the outer end of the transverse partition panel 228 by a partially slit scoreline 238. The transverse partition panels 208 and 210 are cut from portions of the panel 220 extending toward the left from the scorelines 212 and 214 while the transverse partition panels 224 and 228 are cut from portions of the panel 200 extending to the right of the respective scorelines 226 and 230. The scoreline 212 is aligned with the scoreline 226 while the scoreline 214 is aligned with the scoreline 230 to divide the length of the partition panels 196 and 200 into equal third portions. The transverse partition panels 210 and 224 extend to the bottoms of the respective panels 196 and 200 while the panels 208 and 228 have extensions 240 and 242 which extend along the center of the respective panels 208 and 228 to positions spaced slightly above the bottom edges of the panels 196 and 200. Tongues 244 and 246 are cut from the respective transverse partition panels 208 and 228 to remain within the panels 196 and 200. The length of the tongues 244 and 246 is selected so that ends thereof overlap and thus form a double thickness within the center of the center dividing portion of the longitudinal partition panels 196 and 200.

Figure 2:
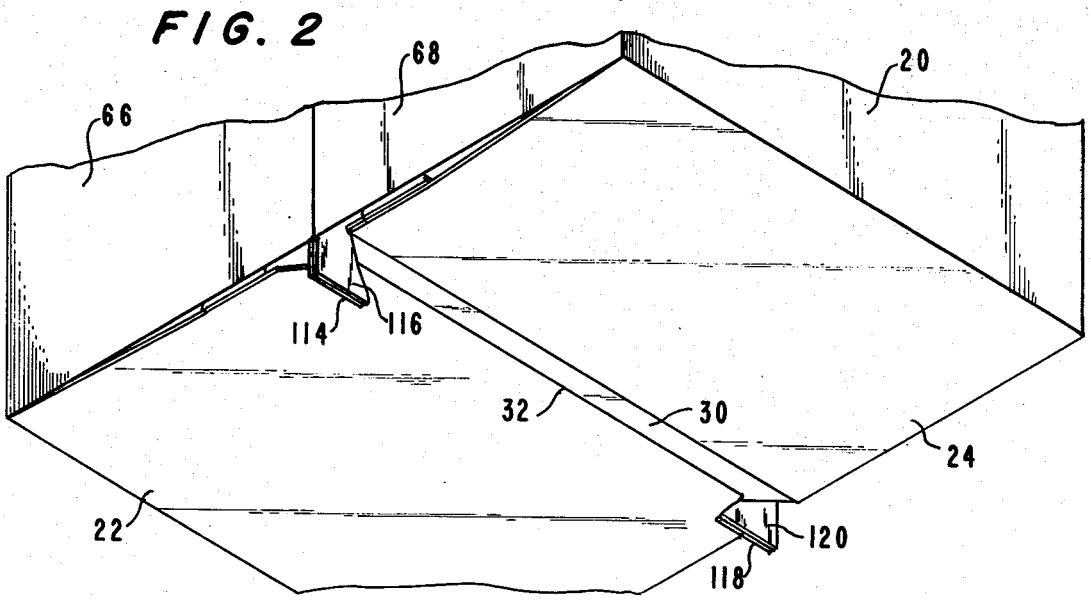
FIG. 2 is a perspective view taken toward the bottom left front corner of the article carrier of FIG. 1.
Figure 3:
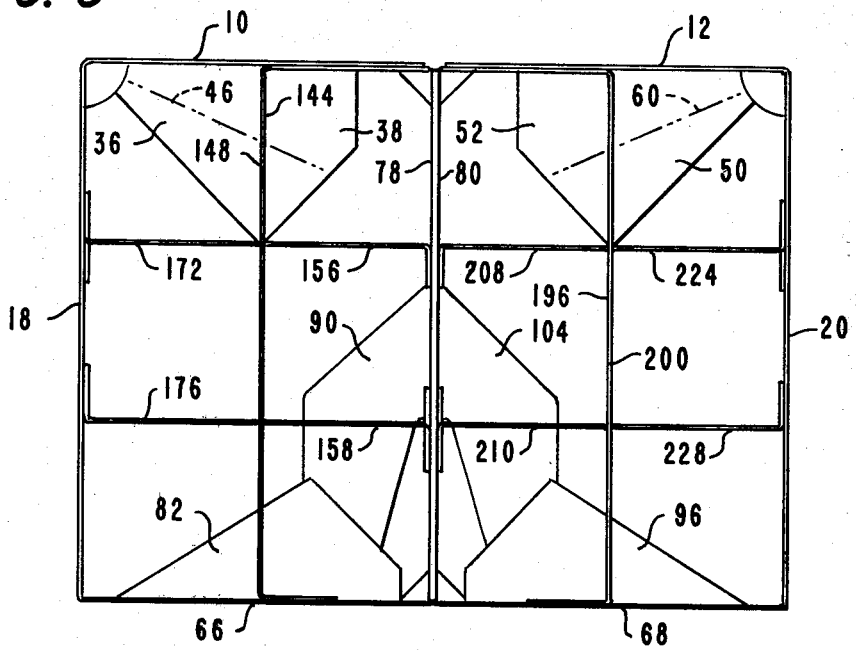
FIG. 3 is a top plan view of the carrier of FIG. 1.
Figure 4:
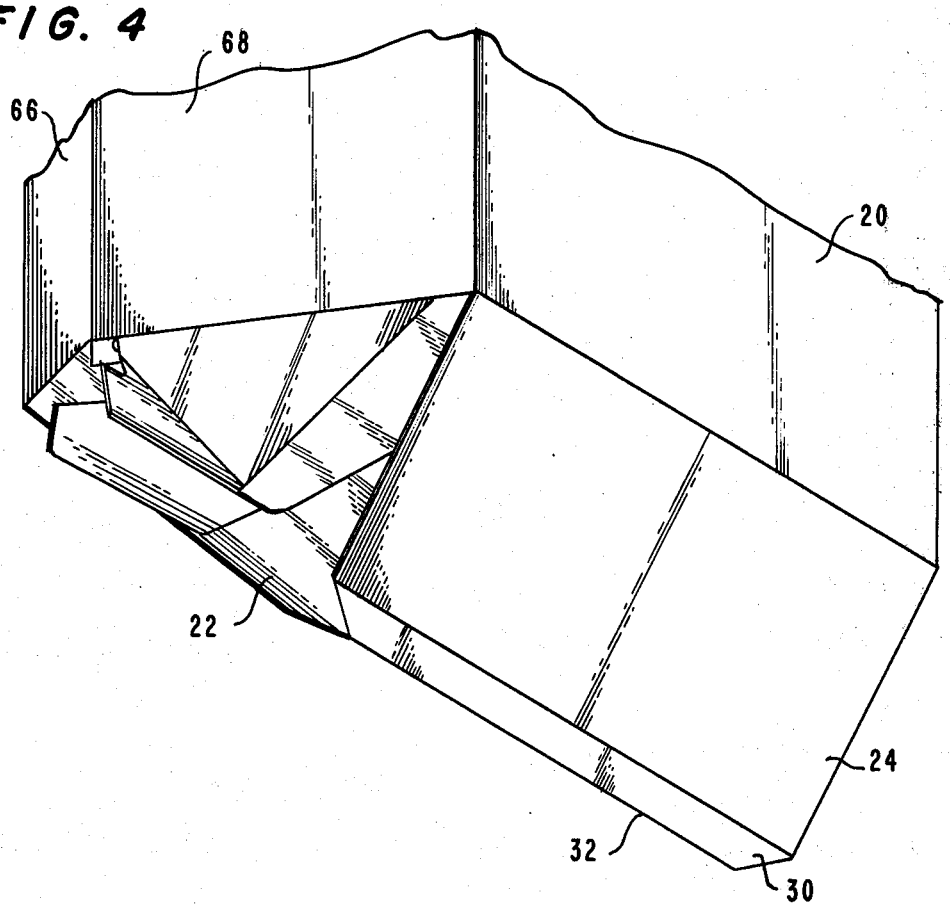
FIG. 4 is a perspective view taken toward the same corner as the view in FIG. 2, but when the carrier of FIG. 1 is in a partially folded condition.

The assembling the blank of FIG. 5 into the carrier shown in FIGS. 1–4 includes the application of glue to the inside surfaces of the panels 148 and 200, or corresponding surfaces of the panels 144 and 196, excluding the tongues 192, 194, 244 and 246 as well as the transverse partitions 156, 158, 172, 176, 208, 210, 224 and 228, and then the folding of the panels 148 and 200 underneath the respective panels 158 and 196 to bond the panels 144 and 148 together and to bond the panels 196 and 200 together. Glue is applied to the top surfaces of the tabs 164, 168, 216 and 220, or corresponding surface portions of center panels 78 and 80, and the carrier is folded about the scoreline 146 and 198 to bond the tabs 164, 168, 216 and 220 to the respective center panels 78 and 80. Glue is then applied to the exposed surfaces of the tabs 180, 184, 232 and 236 (or corresponding areas of side panels 18 and 20) as well as to the upper surfaces of the gusset panels 88 and 102 (or corresponding areas of gusset panels 90 and 104) and the exposed surfaces of glue tabs 152 and 204 (or corresponding areas of left end panels 66 and 68); folding of the carrier about the scorelines 74, 76, 92 and 106 results in bonding of the tabs 180 and 184 to the side panel 18, bonding of the tabs 232 and 236 to the side panel 20, bonding of the gusset panel 88 to the gusset panel 90, bonding of the gusset panel 102 to the gusset panel 104, bonding of the tab 152 to the left end panel 66 and bonding of the tab 204 to the front left end panel 68. Glue is applied to the exposed surfaces of the half right end panels 138 and 140 (or corresponding areas of full right end panels 10 and 12) as well as to the upper surfaces of the gusset panels 34 and 48 (or corresponding areas of bottom panels 22 and 24); folding of the full right end panels 10 and 12 about scorelines 14 and 16 as well as the folding of the gusset panels 34, 36, 38, 48, 50 and 52 about the scorelines 40 and 54 results in bonding of the half right end panels 138 and 140 to the inside surfaces of inner portions of the full right end panels 10 and 12 as well as the bonding of the gusset panels 34 and 48 to the bottom panels 22 and 24. Bottom joint flap 30 is folded about scoreline 32 on top of bottom panel 22. Glue is applied to an inner portion of the exposed surface of the flap 30 (or corresponding inner portion of bottom panel 24) and to the exposed surface of one of panels 78 or 80; folding of the carrier about the scoreline 81 brings about bonding of the panels 78 and 80 together as well as the bonding of the joint flap 30 to the top surface of the bottom panel 24 and a portion of the exposed surface of the gusset flap 48. The carrier can then be unfolded as illustrated in FIG. 4 and the hooks 114, 116, 118 and 120 engaged with the bottom panels 22 and 24 at the respective notches 117 and 121 as shown in FIG. 2 to complete the assembly of the carrier.

It is noted that the longitudinal partitions in both the front and rear portions of the carrier including the respective panels 144, 148, 196 and 200 extend substantially the full height of base portions of bottles to be placed in the carrier. Similarly the transverse partitions 156, 158, 172, 176, 208, 210, 224 and 228 also have portions which extend centrally along a substantial portion of the bottoms of the bottles within the carrier to provide substantially full separation of the bottles. This is a substantial improvement over previous twelve-bottle carriers where only upper portions of the bottles were separated by partition straps and the like.

Further the carrier provides for improved support of the bottles reducing sag from the weight of the bottles on the bottom panels 22 and 24. As shown in FIG. 3, gusset panels 90 and 104 hinged on the center portions of the bottom edges of the center panels 78 and 80 extend into the inner center cells of the carrier to help support the bottoms of bottles therein. Gusset panels 82 and 96 hinged on the bottom edges of the left end panels 66 and 68 extend under the left inner cells of the carriers as well as under the left outer cells of the carriers to support bottles therein. Gusset panels 38 and 52 hinged on the bottom edges of end panels 10 and 12 extend into the right inner cells as well as the right outer cells of the container to help support bottles therein. The bottom panels 22 and 24 being hinged on the side walls 18 and 12 adequately support the bottles within the outer central cells of the front and back halves without any necessity for providing additional support.

The construction of the carrier with longitudinal partitions including longitudinal partition panels 144 and 148, 196 and 200 integrally connected at the score lines 146 and 198 to the right end of the carrier including the panels 138, 140, 10 and 12 and connected by tabs 152 and 204 to left end panels 66 and 68 represents a substantially new and improved construction in a twelve-bottle carrier. Further the transverse partition panels 156, 158, 172, 176, 208, 210, 224 and 228 cut from the longitudinal panels 144, 148, 196 and 200 provides for substantial improvement in the manufacture of twelve-bottle carriers. The cutting and folding of the transverse partitions in opposite directions from the longitudinal partition panels to form the transverse dividers allows for full separation by both the transverse dividers as well as the longitudinal dividers in the 12-bottle carrier. The provision of the tongues 192, 194, 244 and 246 aids in providing separation of the bottles by the longitudinal partition between center bottles in the rows in the front and back halves in the carrier. The extensions 188, 190, 240 and 242 on the respective transverse partitions further aid in full separation of the bottles in the carrier.

Figure 6:
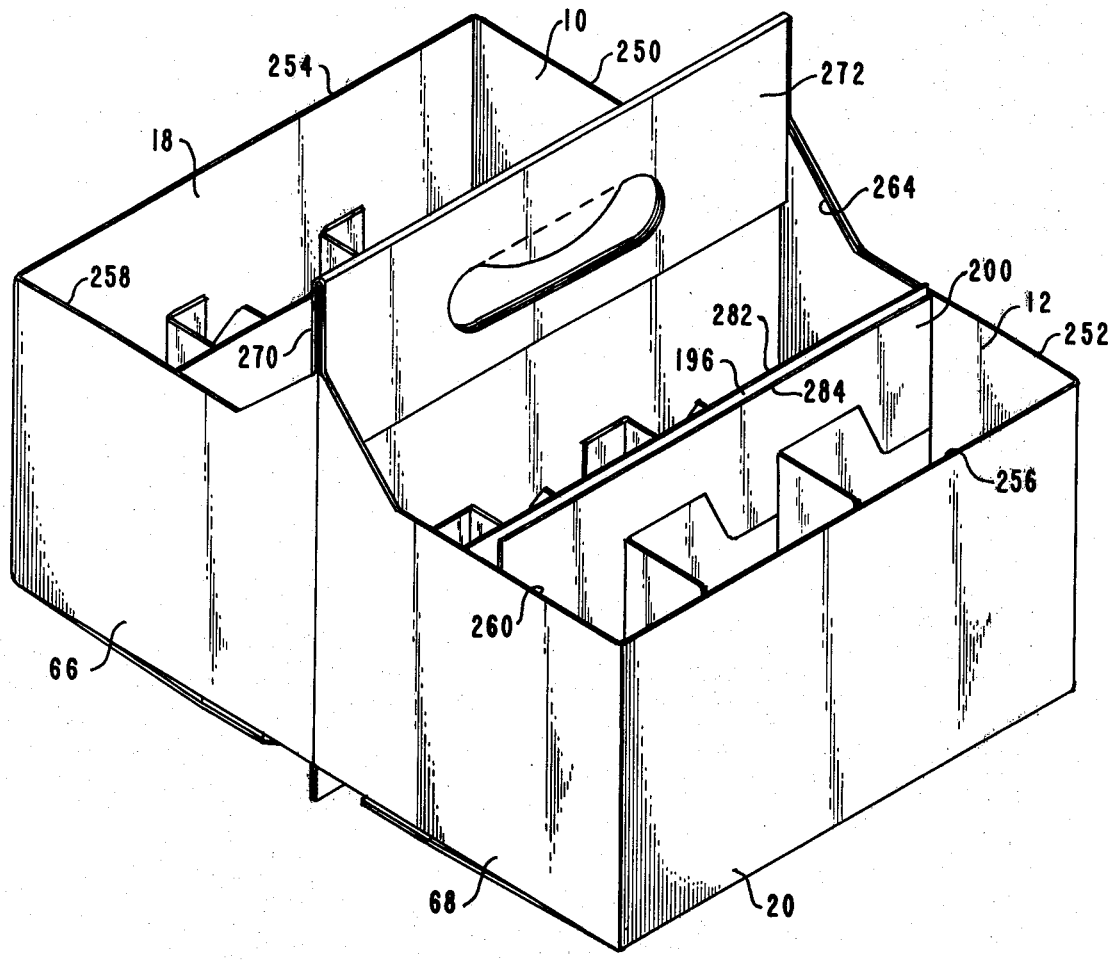
FIG. 6 is a perspective view taken toward the upper left front corner of a modified carrier in accordance with the invention.
Figure 7:
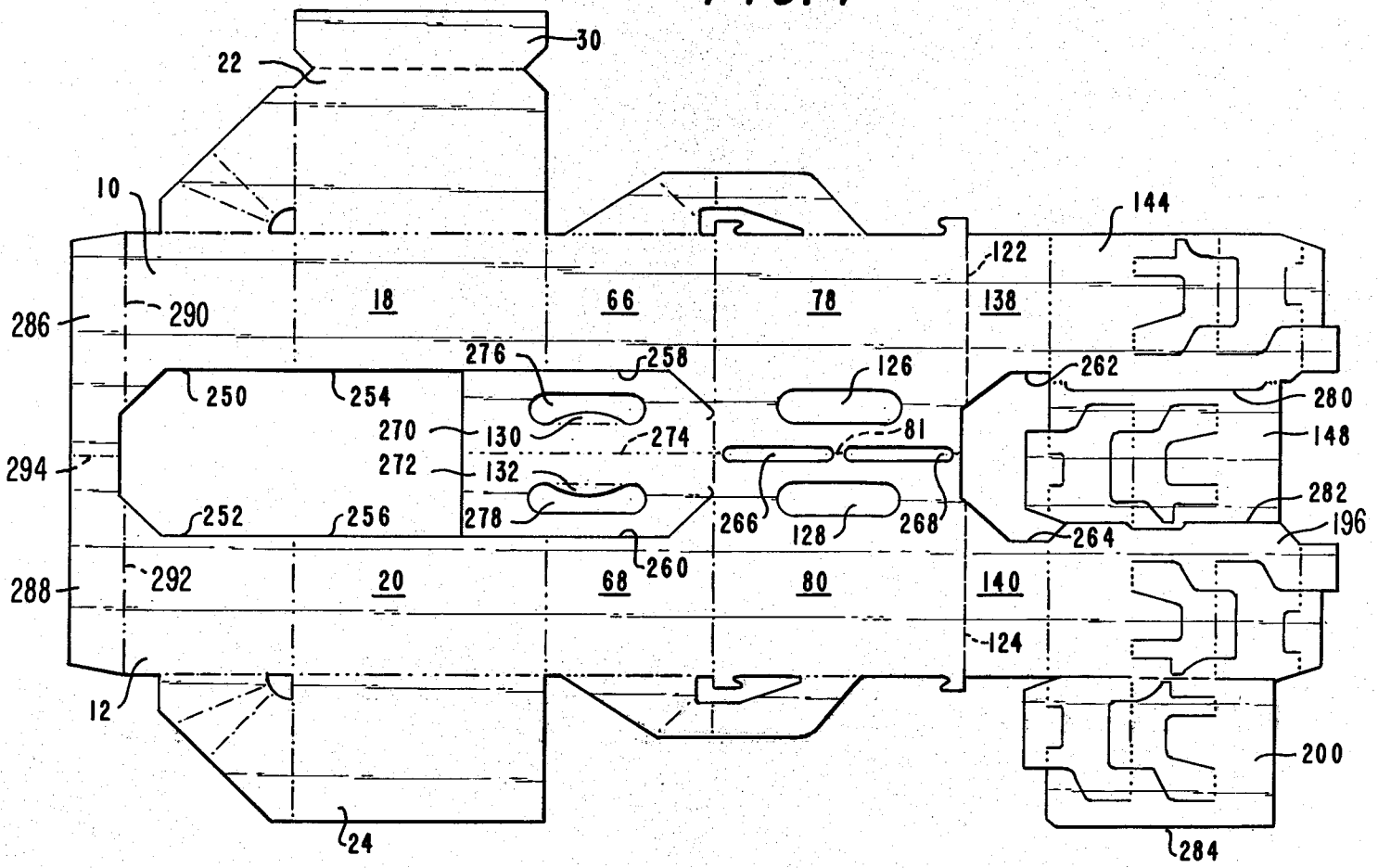
FIG. 7 is a plan view of a blank for forming the modified carrier of FIG. 6.

In a modified carrier illustrated in FIGS. 6 and 7, some parts are identified by the same numbers used to identify parts in the carrier shown in FIGS. 1–5 indicating that such similar parts have substantially the same structure and/or function. The carrier of FIG. 6 differs from the carrier of FIG. 1 in that the top edges of the rear and front side panels 18 and 20 as well as the end panels 10, 12, 66 and 68 are cut down and the handle portion of the carrier is doubled.

As shown in FIG. 7, the blank is cut to form top edges 250 and 252 on the full right end panels 10 and 12, top edges 254 and 256 on the rear and front side panels 18 and 20, top edges 258 and 260 on the top edges of the left end panels 66 and 68, and top edges 262 and 264 on the top edges of the half right end panels 138 and 140. These top edges are designed to provide for allowing the top portions of the bottles to extend above the sides and ends of the carrier.

The inside handle portion at the upper ends of the center panels 78 and 80 have slits 266 and 268 formed therebetween to relieve the thickness of the material at the top edge thereof. Outside handle portions 270 and 272 are formed by a portion of the paperboard cut to form the lowered edges 254, 256, 258 and 260. These handle portions 270 and 272 are hinged together at a slit scoreline 274 and include respective finger openings 276 and 278 designed to be aligned with the openings 126 and 128 in the panels 78 and 80. The reinforcing flaps 130 and 132 are formed in the openings 276 and 278 rather than in the openings 126 and 128.

Further, top edges 280, 282, and 284 on the panels 144, 196 and 200 are formed to extend slightly above the edges of the side and end walls of the carrier.

Center riser flaps 286 and 288 are hinged to inner edges of the respective full right end panels 10 and 12 at partially slit scorelines 290 and 292. The flaps 286 and 288 are hinged together at partially slit scoreline 294. The slit scorelines 122 and 124 between panels 78 and 138 and between panels 80 and 140 are formed with much longer slits to permit easier bending of the carrier along the scorelines 290, 292 which are superimposed within scorelines 122 and 124.

The carrier shown in FIG. 5 is assembled in a manner similar to the carrier of FIGS. 1–5 except that glue is applied to the upper surface of the handle portions 270 and 272 (or corresponding areas of panels 78 and 80) and these handle portions are folded on top of the handle portions of the panels 78 and 80 to bond the handle portions 270 and 272 to the panels 78 and 80 prior to the folding of the carrier about scorelines 122 and 124. Also glue is applied to the upper surfaces of flaps 286 and 288 (or corresponding portions of center panels 78 and 80) prior to the folding of the panels 10 and 12 on top of the exposed surfaces of panels 138 and 140; this folding bringing about the bonding of the flaps 286 and 288 to the center panels 78 and 80. The flaps 286 and 288 are also bonded to each other when the front and back halves of the carrier flaps are folded together by glue applied to one of the flaps 286 and 288.

Since many variations, modifications and changes in detail may be made to the above described invention, it is intended that all matter in the foregoing description and shown in the accompanying drawings be interpreted as illustrative and not in a limiting sense.

What is claimed is

1. A foldable carrier for holding twelve articles, comprising front and rear center panels secured back-to-back and having upper handle portions;

front and rear first end panels hinged at inner edges thereof on first end edges of the respective front and rear center panels;

front and rear side panels hinged at first end edges thereof on outer edges of the respective front and rear first end panels;

front and rear full second end panels hinged at outer edges thereof on second end edges of the respective front and rear side panels;

front and rear half second end panels hinged at inner edges thereof on second end edges of the respective front and rear center panels and secured to inside surfaces of inner portions of the respective front and rear full second end panels;

front and rear bottom panel means hinged at outer edges thereof to bottom edges of the respective front and rear side panels and hinged at inner edges thereof to each other;

front and rear longitudinal partition panel means hinged at second end edges thereof to outer edges of the respective front and rear half second end panels;

said front and rear longitudinal partition panel means extending parallel to and midway between the front center and front side panels and between the rear center and rear side panels, respectively;

said front and rear longitudinal partition panel means having respective tabs at first end edges thereof secured to the respective front and rear first end panels; and eight transverse partition panels having a first pair thereof being spaced and extending between the front side panel and the front longitudinal partition panel means, a second pair thereof being spaced and extending between the front longitudinal partition panel means and the front center panel, a third pair thereof being spaced and extending between the rear center panel and the rear longitudinal partition panel means and a fourth pair thereof being spaced and extending between the rear longitudinal partition panel means and the rear side panel.

2. A foldable carrier as claimed in claim 1 wherein the first and fourth pair of transverse partition panels are cut from and hinged to the respective front and rear longitudinal partition panel means and include tabs on the outer ends thereof secured to the respective front and rear side panels.

3. A foldable carrier as claimed in claim 1 wherein the front and rear longitudinal partition panel means each include inner and outer longitudinal partition panels secured together back to back, the first and fourth pairs of transverse partition panels are cut from and hinged to the respective outer longitudinal partition panels and include respective tabs secured to the respective front and rear side panels, and the second and third pairs of transverse partition panels are cut from and hinged to the respective inner longitudinal partition panels and include respective tabs on the inner ends thereof secured to the respective front and rear center panels.

4. A foldable carrier as claimed in claim 3 wherein the first and fourth pairs of transverse partition panels are cut from and hinged to the respective outer longitudinal partition panels in a direction which is opposite to the direction that the second and third pairs of transverse partition panels are cut from and hinged to the respective inner longitudinal partition panels.

5. A foldable carrier as claimed in claim 4 wherein the front and rear longitudinal partition panel means each include a pair of tongues of the respective inner and outer longitudinal partition panels cut from transverse partition panels, each pair of tongues extending toward each other within an opening formed within the respective longitudinal partition panel means by the transverse partition panels.

6. A foldable carrier as claimed in claim 5 wherein each pair of tongues of the respective front and rear longitudinal partition panel means have end portions which overlap each other.

7. A foldable carrier as claimed in claim 5 or 6 wherein one of the transverse partition panels of each of the first, second, third and fourth pairs of transverse partition panels includes an extension extending downward therefrom.

8. A foldable carrier as claimed in claim 1 wherein there is included gusset panel means extending into the bottoms of article receiving cells adjoining the front and rear center panels.

9. A foldable carrier as claimed in claim 8 wherein the gusset panel means includes first and second sets of three triangular gusset panels hinged between second end edges of the front and rear bottom panel means and bottom edges of the front and rear full second end panels, said first and second set of gusset panels each having one panel thereof secured to the respective front and rear bottom panels, third and fourth sets of three gusset panels hinged to the bottom edges of the respective front and rear first end panels and front and rear center panels, and said third and fourth sets of gusset panels each having one gusset panel which extends to a central portion of the bottom edges of the respective center panel with an adjacent gusset panel thereof secured to the one gusset panel of the respective third or fourth set.

10. A foldable carrier as claimed in claim 1, 3, 4, 5 or 8 including hooks formed on the first and second ends of the bottom edges of the front and rear center panels, and wherein the front and rear bottom panel means includes a front bottom panel hinged to the bottom edge of the front side panel, a rear bottom panel hinged to the bottom edge of the rear side panel, and a joint flap hinged to the inner edge of the rear bottom panel and secured to the inner edge portion of the front bottom panel, there are first and second notches formed in the first and second edges of the rear bottom panel and bottom joint flaps at the hinge therebetween for receiving the respective first and second hooks, and the front and rear center panels are joined together at the top edges thereof along a scoreline.

11. A foldable carrier as claimed in claim 1, 3, 4, 5 or 8 including front and rear outside handle reinforcing panels secured to the upper handle portions of the front and rear center panels, and front and rear center riser flaps hinged at outer edges thereof to inner edges of the respective front and rear full second end panels and secured between second end portions of the front and rear center panels.

* * * * *